US009349285B1

(12) United States Patent
Fowe

(10) Patent No.: US 9,349,285 B1
(45) Date of Patent: May 24, 2016

(54) TRAFFIC CLASSIFICATION BASED ON SPATIAL NEIGHBOR MODEL

(71) Applicant: HERE Global B.V., Veldhoven (NL)

(72) Inventor: James Fowe, Evanston, IL (US)

(73) Assignee: HERE Global B.V., Veldhoven (NL)

( * ) Notice: Subject to any disclaimer, the term of this patent is extended or adjusted under 35 U.S.C. 154(b) by 0 days.

(21) Appl. No.: 14/556,683

(22) Filed: Dec. 1, 2014

(51) Int. Cl.
*G08G 1/00* (2006.01)
*G08G 1/01* (2006.01)
*G08G 1/0967* (2006.01)

(52) U.S. Cl.
CPC ..... *G08G 1/00* (2013.01); *G08G 1/0104* (2013.01); *G08G 1/096716* (2013.01)

(58) Field of Classification Search
USPC ..... 701/23, 532, 117–119; 703/6; 370/254–256; 382/173
See application file for complete search history.

(56) References Cited

U.S. PATENT DOCUMENTS

| | | | | |
|---|---|---|---|---|
| 6,278,965 | B1 * | 8/2001 | Glass et al. | 703/22 |
| 7,460,948 | B2 * | 12/2008 | Van Buer et al. | 701/117 |
| 7,899,611 | B2 * | 3/2011 | Downs et al. | 701/117 |
| 8,060,017 | B2 * | 11/2011 | Schlicht et al. | 455/41.2 |
| 2007/0208501 | A1 * | 9/2007 | Downs et al. | 701/119 |
| 2008/0033630 | A1 | 2/2008 | Lee et al. | |
| 2009/0252134 | A1 * | 10/2009 | Schlicht et al. | 370/338 |
| 2010/0188993 | A1 * | 7/2010 | Raleigh | 370/252 |
| 2011/0160987 | A1 * | 6/2011 | Wu et al. | 701/117 |
| 2011/0161261 | A1 | 6/2011 | Wu et al. | |
| 2012/0106428 | A1 * | 5/2012 | Schlicht et al. | 370/312 |
| 2012/0150425 | A1 | 6/2012 | Chapman et al. | |
| 2013/0289865 | A1 | 10/2013 | Miller et al. | |

FOREIGN PATENT DOCUMENTS

| | | | | |
|---|---|---|---|---|
| CN | 102890862 | | 1/2013 | |
| CN | 102110364 | B * | 12/2013 | 701/117 |
| JP | 2011138486 | A * | 7/2001 | 701/532 |
| JP | 2012048444 | | 3/2012 | |

OTHER PUBLICATIONS

Talley, R.G. and Cistone, J.A., "ASTA Traffic Planner System Description", Report 4J50-AHD-D001, Martin Marietta Corporation, Management and Data Systems, Dec. 1993.*

System integrity and track accuracy methodology for traffic information service-broadcast (TIS-B); Bourgeois, R.L.; Castella, F.R. Digital Avionics Systems Conference, 2004. DASC 04. The 23rd; Year: 2004, vol. 1; pp. 1.B.3-11-10 vol. 1, DOI: 10.1109/DASC.2004.1391237.*

(Continued)

*Primary Examiner* — Cuong H Nguyen
(74) *Attorney, Agent, or Firm* — Lempia Summerfield Katz LLC

(57) ABSTRACT

Systems, methods, and apparatuses are described for estimating traffic conditions on road segments when no real time traffic data is available. A computing device may access a road topology comprising links from a geographic database. One of the links is selected from road topology. The computing device identifies a subset of the road topology having neighboring links that have an influentual conditional probability on the selected link. In one example, the subset of the neighboring links includes parent links for the selected link, child links for the selected link, and parents of child links of the selected link. The computing device generates a traffic estimation model for the selected link using the subset of road topology and historical traffic data for the neighboring links.

19 Claims, 12 Drawing Sheets

Upstream (Parents)

| | L1 | L2 | L3 | L4 | L5 | L6 | L7 | L8 | L9 |
|---|---|---|---|---|---|---|---|---|---|
| L1 | x | 1 | 1 | | | | | | |
| L2 | | x | | | | | | | |
| L3 | | | x | | | | | | |
| L4 | | 1 | 1 | x | | | | | |
| L5 | | | | 1 | x | | | 1 | |
| L6 | | | | 1 | | x | | 1 | |
| L7 | | | | | 1 | | x | | |
| L8 | | | | | | | | x | 1 |
| L9 | | 1 | 1 | | | | | | x |

(56) References Cited

OTHER PUBLICATIONS

Estimating Road Traffic Congestion using Vehicle Velocity; Pattara-Atikom, W.; Pongpaibool, P.; Thajchayapong, S. ITS Telecommunications Proceedings, 2006 6th International Conference on; Year: 2006 pp. 1001-1004, DOI: 10.1109/ITST.2006.288722.*

Monocular visual localization using road structural features; Yufeng Yu; Huijing Zhao; Davoine, F.; Jinshi Cui; Hongbin Zha Intelligent Vehicles Symposium Proceedings, 2014 IEEE; Year: 2014; pp. 693-699, DOI: 10.1109/IVS.2014.6856539.*

Access network traffic models for energy efficient architectures; Morici, A.; Gajic, D.; Di Gregorio, L.; Computer Aided Modeling and Design of Communication Links and Networks (CAMAD), 2013 IEEE 18th International Workshop on; Year: 2013 pp. 43-47, DOI: 10.1109/CAMAD.2013.6708086.*

Finite state Markov model for effective bandwidth calculation in wireless packet networks; Kundu, S.R.; Basu, K.; Das, S.K. Modeling and Optimization in Mobile, Ad Hoc, and Wireless Networks, 2005. WIOPT 2005. Third International Symposium on Year: 2005; pp. 351-357, DOI: 10.1109/WIOPT.2005.22.*

Herring et al., Estimating Arterial Traffic Conditions Using Sparse Probe Data, Sep. 19-22, 2010, 13th International IEEE Conference on Intelligent Transportation Systems.

Sun et al., Traffic Flow Forecasting Using a Spatio-Temporal Bayesian Network Predictor, Sep. 11, 2005, pp. 273-278, Tsinghua University.

* cited by examiner

Upstream (Parents)

| | L1 | L2 | L3 | L4 | L5 | L6 | L7 | L8 | L9 |
|---|---|---|---|---|---|---|---|---|---|
| L1 | x | 1 | 1 | | | | | | |
| L2 | | x | | | | | | | |
| L3 | | | x | | | | | | |
| L4 | | 1 | 1 | x | | | | | |
| L5 | | | | 1 | x | | | 1 | |
| L6 | | | | 1 | | x | | 1 | |
| L7 | | | | | 1 | | x | | |
| L8 | | | | | | | | x | 1 |
| L9 | | 1 | 1 | | | | | | x |

Downstream (Children)

| | L1 | L2 | L3 | L4 | L5 | L6 | L7 | L8 | L9 |
|---|---|---|---|---|---|---|---|---|---|
| L1 | x | | | | | | | | |
| L2 | 1 | x | | 1 | | | | | 1 |
| L3 | 1 | | x | 1 | | | | | 1 |
| L4 | | | | x | 1 | 1 | | | |
| L5 | | | | | x | | 1 | | |
| L6 | | | | | | x | | | |
| L7 | | | | | | | x | | |
| L8 | | | | | 1 | 1 | | x | |
| L9 | | | | | | | | 1 | x |

FIG. 5A

Spatial Neighbors

| | L1 | L2 | L3 | L4 | L5 | L6 | L7 | L8 | L9 |
|---|---|---|---|---|---|---|---|---|---|
| L1 | x | 1 | 1 | | | | | | |
| L2 | 1 | x | 1 | 1 | | | | | 1 |
| L3 | 1 | 1 | x | 1 | | | | | 1 |
| L4 | | 1 | 1 | x | 1 | 1 | | 1 | |
| L5 | | | | 1 | x | | 1 | 1 | |
| L6 | | | | 1 | | x | | 1 | |
| L7 | | | | | 1 | | x | | |
| L8 | | | | 1 | 1 | 1 | | x | 1 |
| L9 | | 1 | 1 | | | | | 1 | x |

FIG. 5B

| | L1 | L2 | L3 | L4 | L5 | L6 | L7 | L8 | L9 | L10 |
|---|---|---|---|---|---|---|---|---|---|---|
| L1 | x | 1 | | | | | | | | |
| L2 | 1 | x | 1 | | | | | | | 1 |
| L3 | | 1 | x | | 1 | 1 | | | | 1 |
| L4 | | | | x | | | | 1 | | |
| L5 | | | 1 | | x | 1 | | | | |
| L6 | | | 1 | | 1 | x | | | | |
| L7 | | | | | | | x | 1 | 1 | |
| L8 | | | | 1 | | | 1 | x | | |
| L9 | | | | | | | | | x | |
| L10 | | 1 | 1 | | | | | | 1 | |

146

TRAFFIC CLASSIFICATION BASED ON SPATIAL NEIGHBOR MODEL

FIELD

The following disclosure relates to a spatial neighbor model, or more particularly, to systems and methods for predicting traffic at one road segment based on other road segments that are spatial neighbors.

BACKGROUND

Traffic reporting is the study of movement of vehicles on the roads. Analytical techniques may manage and track traffic information in order to derive travel times, guide driving behavior and optimize road infrastructure for cities. Traffic Message Channel (TMC) and other traffic services deliver traffic information to customers. Traffic incidents and traffic flow are reported through broadcasts. Traffic delays may be caused by one or more of congestion, construction, accidents, special events (e.g., concerts, sporting events, festivals), weather conditions (e.g., rain, snow, tornado), and so on.

The traffic data may be collected from probes from individual drivers. The individual drivers may travel with tracking devices (e.g., navigation devices or mobile device). However, the saturation rate of road segments having a tracking device at any given point in time may be quite low. In addition, a penetration rate describing the percentage of vehicles acting as a probe may also be quite low. Thus, the available traffic data may be insufficient to represent a complete traffic map.

SUMMARY

In one embodiment, a road topology comprising links is accessed from a geographic database. A processor performs selecting a link from the road topology and identifying a subset of the road topology having neighboring links that have a significant conditional probability on the selected link. A traffic estimation model is generated for the selected link using the subset of road topology and historical traffic data for the neighboring links a historical traffic data for the selected link.

In one embodiment, traffic information is requested for a road topology including a first road link and a second road link. Real time traffic data is received for the first road link. However, no real time traffic data is available for the second road link. For the second road link, estimated traffic information is received from a model generated from a set of causal links that have a causal relationship with the second road link. A conditional probability between each of the causal links and the second road link is greater than a probability threshold, and the causal links include at least one parent link to the second road link, at least one child link to the second road link, and at least one supplemental link that is separated from the second road link by the at least one child link or the at least one parent link.

BRIEF DESCRIPTION OF THE DRAWINGS

Exemplary embodiments are described herein with reference to the following drawings.

FIG. 5A illustrates an example set of child relationships for the traffic flow diagram of FIG. 4A.

FIG. 5B illustrates an example spatial neighbor matrix based on the set of parent relationships from FIG. 4B and the set of child relationships from FIG. 5A.

DETAILED DESCRIPTION

Traffic data may be provided to users from a traffic service provider (TSP). Traffic data may originate with probes. A probe may be a mobile device or tracking device that provides samples of data for the location of a vehicle. The probes may be mobile phones running specialized applications that collect location data as people drive along roads as part of their daily lives. A probe may be stationary sensor such as an inductance loop or optical detector (e.g., camera, light detection and ranging (LiDAR), or radar device). The probes may report the quantity, frequency, or speed of vehicles as they travel road segments. The road segment may be determined based on the geographical coordinates of the probe (e.g., global positioning system (GPS)).

The traffic data from probes may be presented on a map. A color coding or another technique may graphically represent the traffic levels on various road segments. For example, green may represent no congestion, yellow may represent slowed but flowing traffic, red may represent significantly slowed traffic, and black may represent substantially stopped traffic. However, the traffic data for probes may not be complete. For example, no mobile devices may be traveling on a particular road segment or no stationary probes may exist for a particular road segment. In addition, the penetration rate of the number of vehicles having a probe may be low. Accordingly, TSPs may not have enough traffic proves for real time traffic processing. TSPs may publish real time traffic only on road segments where there are vehicles in real time.

The following disclosure relates to concurrent traffic forecasting. Concurrent traffic forecasting relates to the ability to predict what the current traffic condition of a particular road segment is given the traffic condition of the neighboring links. In some examples, precise traffic forecasting units of speed (e.g., miles per hour or meters per second) may be possible, but users often only require broad ranges of speed (e.g., green, yellow, red, and black). Exact floating point numbers for the traffic may not be useful to most users. Concurrent traffic forecasting in the following examples provide forecasts or predicts for the current traffic on a road segment based on a classification based on a range of speed without any traffic data for the road segment.

Figure 1:
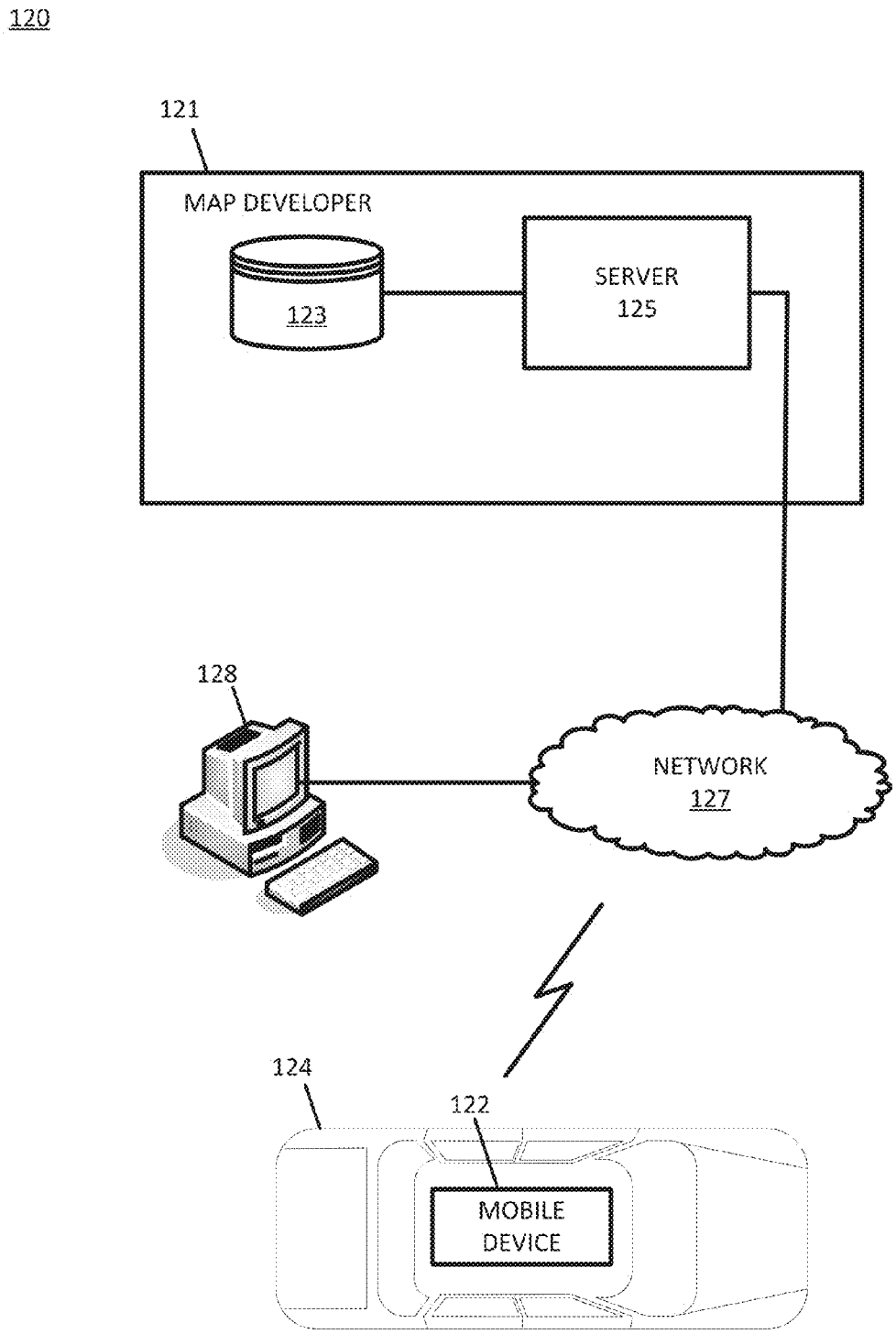
FIG. 1 illustrates an example system for traffic classification based on a spatial neighbor model.

FIG. 1 illustrates an example system 120 for predicted traffic levels based on spatial neighbors. The system 120 includes a developer system 121, one or more mobile devices 122, a workstation 128, and a network 127. Additional, different, or fewer components may be provided. For example, many mobile devices 122 and/or workstations 128 connect with the network 127. The developer system 121 includes a server 125 and one or more databases. The database 123 may be a geographic database including road links or segments.

The server 125 may access a road topology form the database 123. The road topology defines an arrangement of multiple road segments or links. The road topology is a causal network, which means that traffic on any given link is an indicator of traffic on at least one other link. The road topology may be represented using a map, a line diagram, or a data table. The road topology includes comprehensive data for the road network for at least one road link. The term comprehensive data means data indicative of all road links that flow directly into a particular road link and away from the particular road segment. The comprehensive data may also include all of the road links that indirectly flow into the particular road link from exactly one road link away.

The server 125 may select a link from the links for which the road topology has comprehensive data. The server 125 may identify a subset of the road topology having neighboring links that have a significant conditional probability on the selected link. The term significant conditional probability means that traffic on the selected link depends, at least in part and in at least some instances, on traffic conditions on the neighboring links.

The server 125 may access historical the traffic data for the selected link and the neighboring links, which together make up a subset of the road topology. The historical traffic data may include speed values or traffic classifications. The historical traffic data may be organized in time periods or epochs. Example sizes for time epochs include 15 minutes, 30 minutes, 1 hour, or another value. The historical data may be the training data for a spatial neighbor model to predict traffic conditions on the selected link. That is, the server 125 may designate that the historical data for the neighboring links is the input and the historical data for the selected link is the output for a spatial neighbor model. The spatial neighbor model may include a Bayesian model, a neural network, a decision tree, a random forest, or another model for determining sign placement as a function of one or more of the characteristics.

Once the spatial neighbor model is constructed, the server 125 may subsequently receive current traffic data for the neighboring links as collected by probes. The server 125 may apply the current traffic data for the neighboring links to spatial neighbor model for the selected link. The server 125 receives from the machine learned model a current traffic level for the selected link from the model for the selected link. The current traffic level may be a classification, category, or coloring of traffic condition. For example, the current traffic level may be represented by data indicative of free-flow (e.g., color green), slightly congested (e.g., color yellow) congested (e.g., color red) or non-moving traffic (e.g., color black).

The mobile device 122 may be a personal navigation device ("PND"), a portable navigation device smart phone, a mobile phone, a personal digital assistant ("PDA"), a tablet computer, a notebook computer, and/or any other known or later developed mobile device or personal computer. Non-limiting embodiments of navigation devices may also include relational database service devices, mobile phone devices, or car navigation devices.

The developer system 121, the workstation 128, and the mobile device 122 are coupled with the network 127. The phrase "coupled with" is defined to mean directly connected to or indirectly connected through one or more intermediate components. Such intermediate components may include hardware and/or software-based components.

The computing resources may be divided between the server 125 and the mobile device 122. In some embodiments, the server 125 performs a majority of the processing. In other embodiments, the mobile device 122 or the workstation 128 performs a majority of the processing. In addition, the processing is divided substantially evenly between the server 125 and the mobile device 122 or workstation 128.

Figure 2:
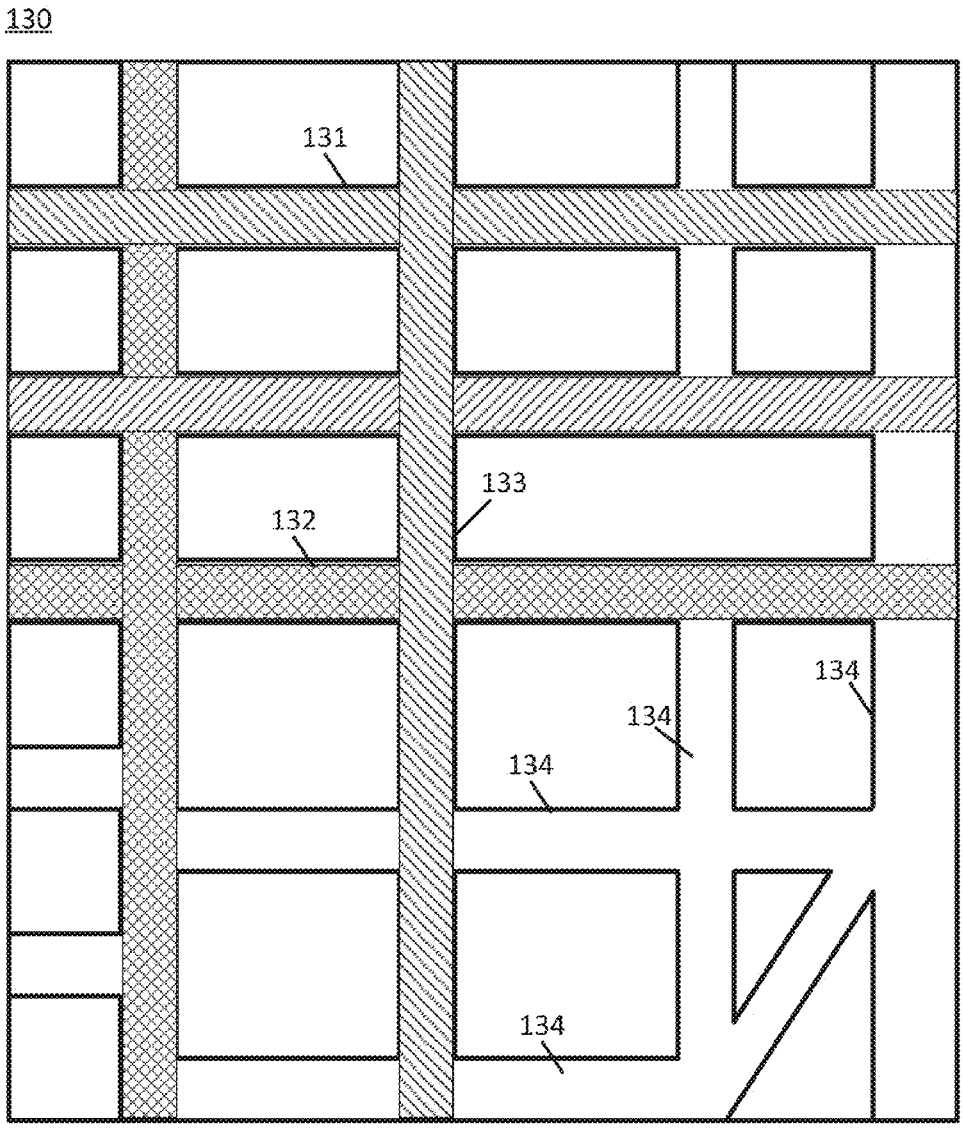
FIG. 2 illustrates an example traffic map.

FIG. 2 illustrates an example traffic map 130. The map is one graphical representation of road links. Some of the road links in traffic map 130 are coded for traffic levels and some of the road links are not. Road links 131, 132, and 133 are encoded for traffic levels. One cross-hatching for road link 131 may represent low traffic congestion or free moving traffic. Another cross-hatching for road link 132 may represent medium traffic congestion or medium speeds. Another cross-hatching for road link 133 may represent high traffic congestion or low speeds.

The traffic levels may be defined by ranges of speeds. Example ranges of speeds include 0 to 5, 6 to 20, 21 to 50, and 51 and above. Any ranges may be used. Example units for the ranges of speeds include miles per hour, kilometers per hour, meters per second, feet per second, or other units. Example ranges of speed include 0 to 20% of the rated speed of the road segment, 21% to 50% of the rated speed of the road segment, 51% to 90% of the rated speed of the road segment, and above 90% of the rated speed of the road segment. The rated speed of the road segment may be defined by the speed limit of the road segment, the average speed of the road segment, or another value. These values may be stored as attributes of road links in the database 123. Several of the road links (e.g., road links 134) may not be represented by traffic levels. Traffic data may not be available for road links 134. For example, for a given period of time, no probe data for the road links 134 is available in the database 123.

Figure 3:
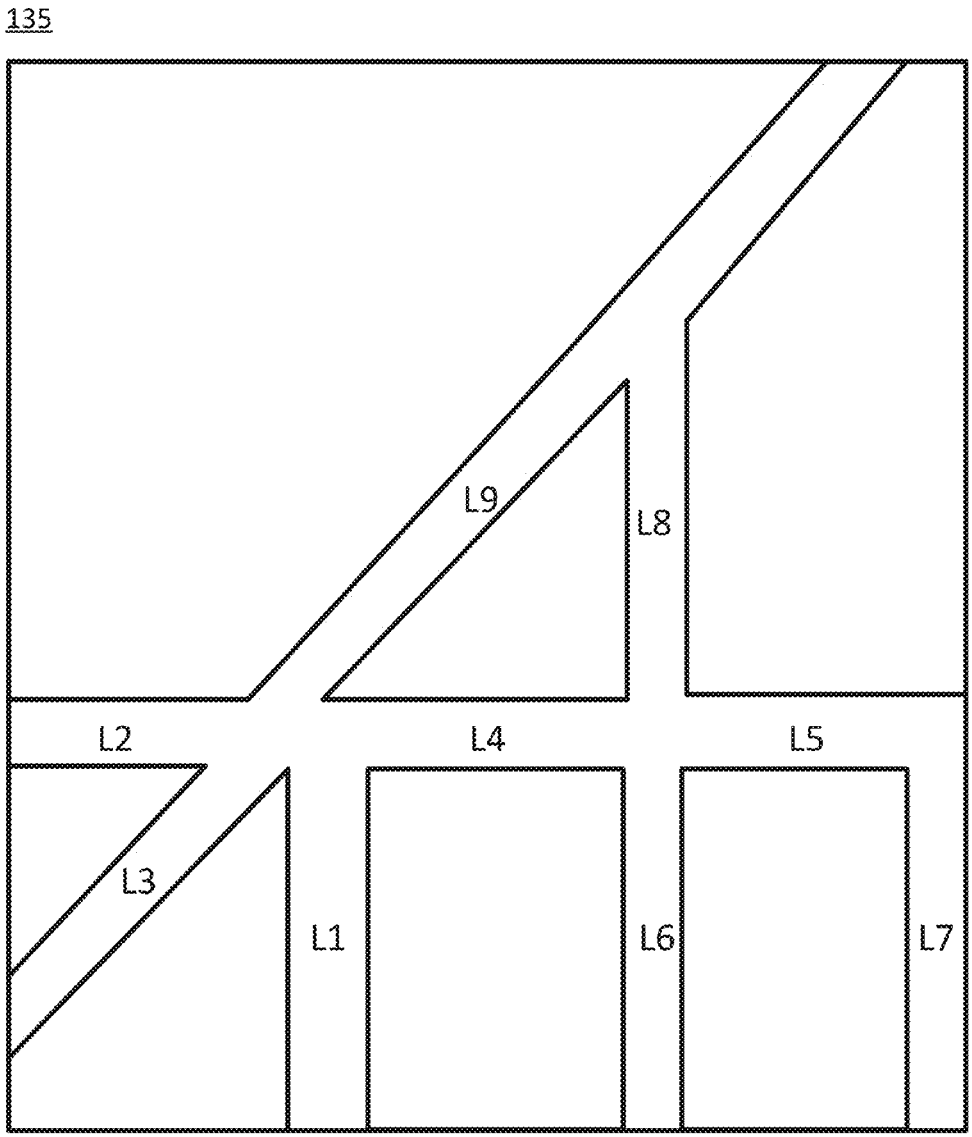
FIG. 3 illustrates an example road topology.

FIG. 3 illustrates an example road topology 135 or road map including road links L1-L9. The road topology 135, and other transportation networks, are directed graph network with multiple causal effects. An incident event on one link propagates to one or more other links. Most heavy congestion propagates to upstream neighboring links. In addition, more subtle causal effects exist between links. Links that are not directly connected may affect one another. These dynamic relationships between the links of a transportation network mean that conditional probabilities exist between the links. That is, the traffic condition on a link is as a result of the traffic situation on another link.

In a transportation network, the downstream links may have the most influence on the traffic condition of a link because traffic normally backs up in the upstream direction. Links that are directly upstream may also have significant influence on the link. When both upstream and downstream links are congested, the middle link very likely to be congested. Other relationships may exist.

Figures 4A, 4B:
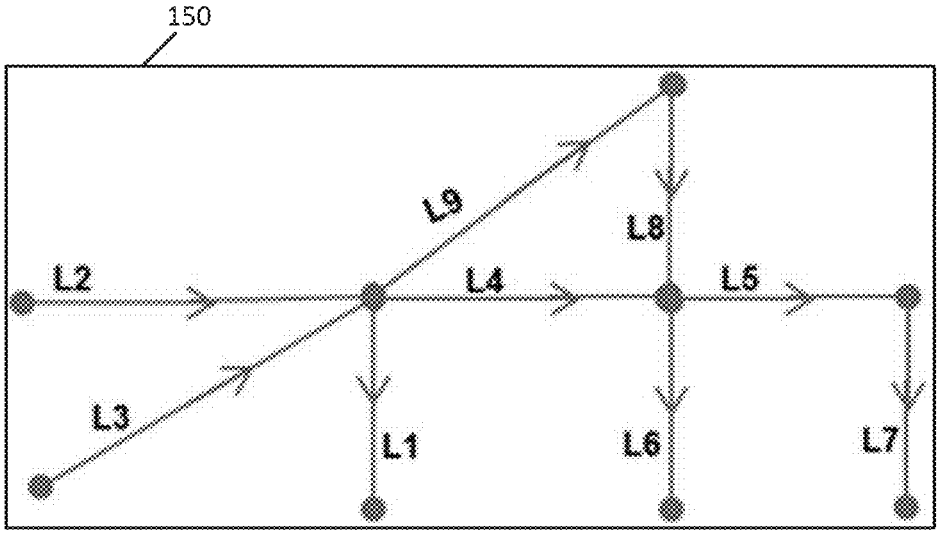
FIG. 4A illustrates an example traffic flow diagram for the road topology of FIG. 3.
FIG. 4B illustrates an example set of parent relationships for the line diagram of FIG. 4A.

FIG. 4A illustrates an example traffic flow diagram for the road topology of FIG. 3. Each of the links L1-L9 are represented by an arrow connecting the link to one or more other link. The direction of the arrow indicates the direction of traffic on the link. Each arrow in FIG. 4A represents one of the roads shown in map 135 of FIG. 3.

FIG. 4B illustrates an example set of parent relationships for the flow diagram of FIG. 4A. The parent relationships are shown in a chart that indicates whether or not each of links L1-L9 feed traffic into each of the other links L1-L9. That is, since L2 can feed traffic into links L1, L4, and L9, the column for L2 has a "1" in the rows for each of links L1, L4, and L9. All possible intersection are represented by the chart. The negatively sloped diagonal includes an "x" at each location to represent that a link cannot feed traffic into itself.

FIG. 5A illustrates an example set of child relationships for the line diagram of FIG. 4A. The child relationship are shown in a chart that indicates whether or not each of links L1-L9 feed traffic into each of the other links L1-L9. That is, because links L2 and L3 have no links feeding into them, the columns for links L2 and L3 are empty. In addition, because links L2 and L3 feed into links L1, L4, and L9, the columns for links L1, L4, and L9 include a "1" in the rows for links L2 and L3. The chart of FIG. 5A and the chart of FIG. 4B may be inversions of each other.

FIG. 5B illustrates an example spatial neighbor chart based on the set of parent relationships from FIG. 4B and the set of child relationships from FIG. 5A. The spatial neighbor chart may include both the parent relationship and the child relationships. In addition, the spatial neighbor may include supplemental relationships.

The supplemental relationships represent causal relationships between road links that are not directly connected. In the example of FIG. 5B there are two supplemental relationships. One relationship is between links L2 and L3, and the other is between links L4 and L8. Referring back to FIG. 4A, it can be seen that traffic cannot flow directly between links L2 and L3. However, if traffic were to be backed up in the L2-L9, L2-L4, or L2-L1 paths, traffic in link L3 would likely be affect. A similar relationship can be seen between links L4 and L8. In one example, the neighboring links and the links with supplemental relationships may be described as parent links of a specific link, child links of the specific link, and parent links of the child links of the selected link.

The supplemental relationships may be defined according to the Markovian property of a stochastic transportation network to identify nearest neighbor of influence to every link that would be a representative of the influence all other links in the network as on it. The set of causal effects for these relationships may be described by a Markov blanket. The stochastic influence on a link in the network can be captured inside the "Markov blanket" such that every link within a link's Markov blanket (MB) is a representative of all the influence the whole network has on its traffic condition according to the road intersections in the road topology.

The Markov blanket may be limited according to one or more attributes of the road network. For example, the Markov blanket may be reduced to only include causal effects between road links of the same functional classification. The chart of FIG. 5B may be filtered to remove certain values. Thus, the chart of FIG. 5B may be filtered to include affirmative ("1") values only when the affected links are stored in the database 123 with the same functional classification attribute. In other words, the system may designate that highways only affect other highways and surface streets may only affect other surface streets. In another example, the Markov blanket may be reduced to only include causal effects between certain functional classifications. The chart of FIG. 5B may be filtered to remove the affirmative values when the functional classification different by more than a predetermined number (e.g., 1, 2 or 3).

In another examples, the links with the supplemental relationship may be selected based on a conditional probability between links. The conditional probability of link A on link B may be the probability that link B is experiencing traffic given link A is experiencing traffic. A shield link may be defined as a last link in a chain that shields the selected link from links that do not have significant impact on the selected link. The shield link may be the leaf or outer links in the road topology or a selected subset of the road topology. The road topology, or spatial neighbor chart, may be constructed to exclude links past the shield links. For any links past the shield links, in a remainder of the road network, a conditional probability between the selected link and any links in the remainder of the road topology is less than a minimum threshold probability. Examples for the minimum threshold probability include 0.2, 0.1, 0.01, or 0.001. The conditional relationship between the links in the spatial neighbor group (e.g., parent links, child links, and supplemental links) and the selected link may be greater than the minimum threshold probability. Example supplemental links include one or more parents of the child links.

Consider the example of link L4 in the example of FIG. 4A. Link L4 may be influenced by links five other links: L4={L2, L3, L5, L6 & L8}, as shown by the links in the row of L4 in the spatial neighbor chart. In the example of four traffic levels (R=Red, Y=Yellow, G=Green, B=Black), some possible combinations for the influencing links may be (R, Y, R, R, R), (R, Y, R, G, Y) or (Y, B, R, R, G). All possible patterns of 4 different color types (N) on 5 possible influencing links (M) is $N^M=4^5=1024$. Therefore, there are 1024 possibilities of different traffic conditions exhibited by the neighbors of link L4.

Using historical data set of these neighboring colors, the spatial neighbor model is generated. Each line in the historical data for L4 may be possible combinations of the influencing links, which may be by classification (R, Y, R, R, R) or by absolute speed (10, 32, 12, 14, 5). The spatial neighbor model is trained (e.g., accordingly to Bayesian, neural network, fuzzy network, or other techniques) with the possible combinations of influencing links as the inputs and the known traffic level of the selected link as the output.

The historical data may be lumped together as one large training set. In another example, the historical data may be divided defined according to time of day, day of year, or day of week. Thus, a different training set is used for each day of the week, each hour or hour range of the day, or in another categorization. In one example of finely divided timer period, 15 minute epochs are used, and the traffic data is formatted into 96-dimensional vectors, in which each of the 96 components describe traffic for a different 15 minute epoch. For example, a daily traffic vector having 96 components may be defined as $\vec{x}=(x_1, \ldots, x_n)$, where n=96. The values contained in the vector may be speeds for a given epoch. For example, the first element of the vector is the average speed for time between 0:00 a.m. to 0:15 a.m., and the 50th element of the vector is the average speed for time between 12:15 p.m. and 12:30 p.m. Other vectors may be used. In another example, some days may have only two time epochs: rush hour and not rush hour.

In one example, the spatial neighbor model is trained using marginal or conditional probabilities. For example, P(L2=R|L4=B) is the probability L2 is red given L4 is black, P(L2=G|L4=B) is the probability L2 is green given L4 is black, P(L2=R|L4=R) is the probability L2 is red given L4 is red, and P(L2=G|L4=G) is the probability L2 is green given L4 is green. The following provides one example algorithm for constructing a spatial neighbor model in a transportation network using conditional probabilities:

Let MB represent a set of links that forms the Markov blanket neighbors of link 1 $MB_l=\{l_1, l_2, \ldots l_n\}$. Let NCP represent the color patterns of the Markov blanket neighbors of a link given according to Equation 1:

$$NCP_l(t)=Y=\{Y_1,Y_2,\ldots,Y_k\}.$$

Y is a random variable containing all possible color patterns (k) that can be formed by the spatial neighbors (MB) of link l. Y may be an ordered pattern of X of the form of Equation 2:

$$Y_i=\{(X_1:X_2\ldots X_n\}$$

Where X is a random variable of colors with a sample space X={R, G, B, Y, N} i.e. {Red, Green, Black, Yellow, Non}. The color state Non (N) represents neighboring links that do not have data. $X_i$ represents the color at the $i^{th}$ spatial neighbor out of a total n possible neighbors of link l. $Y_i$ represents the $i^{th}$ color patterns out of a total of k possible patterns in the set NCP. It can be shown that $k=X|X|^n=5^n$. Let the possible colors for link l be represented as $C_l=X$.

A probability model is given by Equation 3:

$$P(C_l(t)=X_i \mid NCP_l(t)=Y_j)=\frac{P(NCP_l(t)=Y_j \mid C_l(t)=X_i)\times P(C_l(t)=X_i)}{\sum_{j=1}^{k} P(NCP_l(t)=Y_j \mid C_l(t)=X_i)}$$

Equation 3 may simplify to Equation 4:

$$P(X_i \mid Y_j)=\frac{P(Y_j \mid X_i)\times P(X_i)}{\sum_{j=1}^{k} P(Y_j \mid X_i)}$$

Considering a specific example for L5 above with influencing links having traffic values of X={R,G,Y,B,N}, the spatial neighbors include $MB_{L5}=\{L_4, L_7, L_8\}$ and, therefore, n=3, providing $k=|X|^3=5^3=125$ and $NCP_{L5}(t)=Y=\{Y_1, Y_2,\ldots,Y_{125}\}$.

Thus, a substitution into Equation 3 provides:

$$P(C_l(t)=R \mid NCP_l(t)=Y_1)=\frac{P(NCP_l(t)=Y_1 \mid C_l(t)=R)\times P(C_l(t)=R)}{\sum_{j=1}^{k} P(NCP_l(t)=Y_j \mid C_l(t)=R)}$$

The probability that the color on L8 is Red, given that the pattern of colors on its neighbors is $MB_{L5}=\{L4=Y, L_7=N, L_8=R\}$ and $Y_1=\{YNR\}$ as shown by Equation 4:

$$P(C_{L5}(t)=R \mid NCP_{L5}(t)=Y_1)=\frac{P(NCP_{L5}(t)=Y_1 \mid C_{L5}(t)=R)\times P(C_{L5}(t)=R)}{\sum_{j=1}^{k} P(NCP_{L5}(t)=Y_j \mid C_{L5}(t)=R)}$$

The value $P(NCP_{L5}(t)=Y_1|C_{L5}(t)=R)$ from training data set which is a count how many times the color pattern was {YNR} when the link L5 was red. This is obtained a-priori and all of $P(NCP_{L5}(t)=Y_j|C_{L5}(t)=R)$. The procedure may be repeated for a probability of L5 is G or Y, and all combinations of traffic classifications for each of the links.

Figure 6:
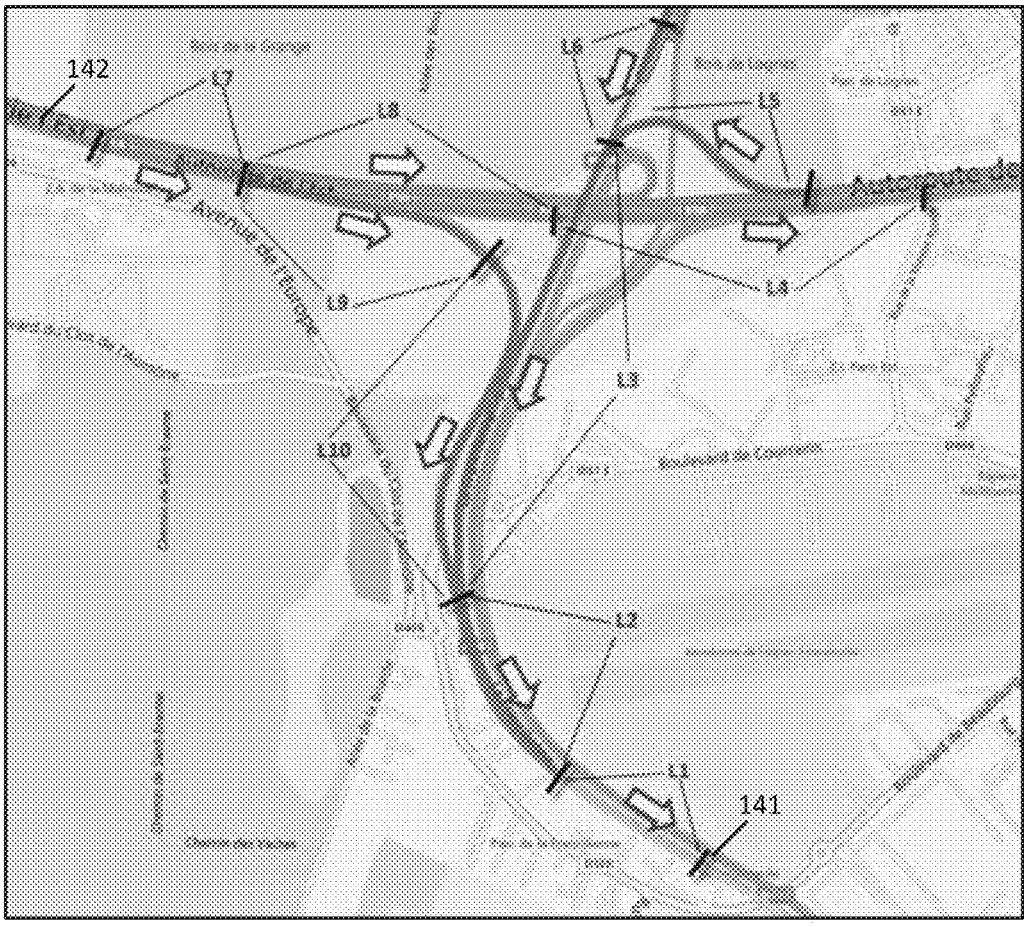
FIG. 6 illustrates another example road topography.
Figures 7A, 7B:
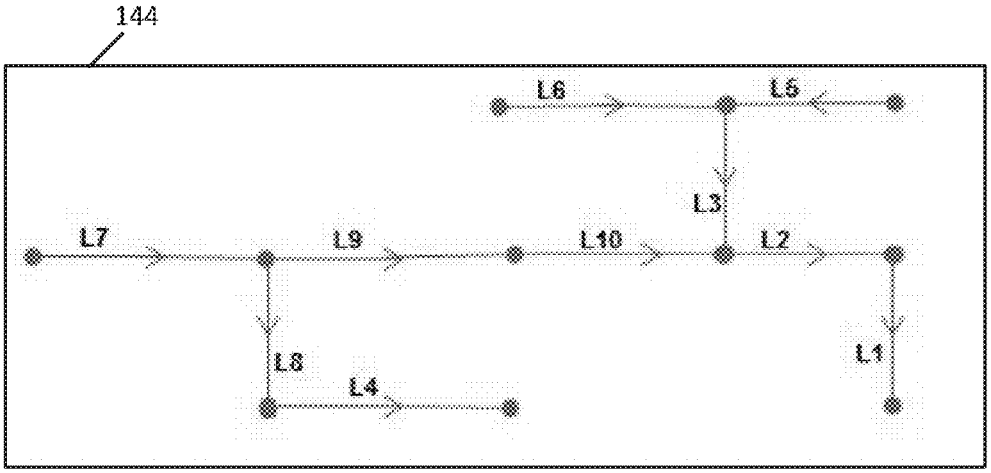
FIG. 7A illustrates a traffic flow diagram of the road topography of FIG. 6.
FIG. 7B illustrates a spatial neighbor matrix for the traffic flow diagram of FIG. 7A.

FIG. 6 illustrates another example road topography 140 having links L1-L10. The road topography includes the intersection and surrounding area for two highways 141 and 142. While the highways 141 and 142 may include traffic flows in two directions, arrows are illustrated for the purpose of this example. The links may include successive segments of each highway, on ramps and off ramps. The on ramps and off ramps may connect the highways to each other or other roads. FIG. 7A illustrates a line diagram 144 of the road topology 140 of FIG. 6. The links of the road topography 140 are illustrated as single direction straight lines to represent the map. FIG. 7B illustrates a spatial neighbor chart 145 for the line diagram 144 of FIG. 7A.

The training dataset may be a random data set in that the data is collected at all different times and days (random times) from the links on road topology 140. The random data set may be probe data collected by mobile devices. The probe data may be intermittently spaced through time. That is, the probe data may be data that happened to be collected by a set of mobile device users having a mobile application for collecting probe data.

Consider L6 as the selected road link L6 and the following conditions:

$$MB=\{L3,L5\}; \quad (1)$$

$$k=5^n=5^2=25; \quad (2)$$

$$NCP_{L6}(t)=Y=\{Y_1,Y_2\ldots,Y_{25}\}; \text{ and} \quad (3)$$

$$NCP_{L6}(t)=Y=\{RR,RG,RY,RB,RN,GG,GR,GY,GB,GN,YY,YR,YG,YB,YN,BB,BR,BG,BY,BN,NN,NR,NG,NY,NB\} \quad (4)$$

The following marginal probabilities may be identified:

$$P(NCP_{L6}(t)=Y_j|C_{L6}(t)=R)$$

$$P(NCP_{L6}(t)=Y_j|C_{L6}(t)=G)$$

$$P(NCP_{L6}(t)=Y_j|C_{L6}(t)=Y)$$

$$P(NCP_{L6}(t)=Y_j|C_{L6}(t)=B)$$

The historic data from the probes may be summarized by classification as shown in Table 1. Each row represents a point of probe data from each of the road links and a given instant in time (e.g., within 1-10 seconds) or during the same time epoch.

TABLE 1

| S/N | L1 | L2 | L3 | L4 | L5 | L6 | L7 | L8 | L9 | L10 |
|---|---|---|---|---|---|---|---|---|---|---|
| 1 | G | G | G | Y | N | N | G | G | G | N |
| 2 | G | G | G | G | G | G | G | G | G | G |
| 3 | Y | R | Y | G | Y | Y | G | G | Y | Y |
| 4 | Y | Y | Y | G | Y | G | G | G | Y | Y |
| 5 | G | G | G | G | N | G | G | G | N | N |
| 6 | G | G | G | G | G | G | G | G | G | G |
| 7 | Y | G | Y | Y | G | Y | G | G | G | G |
| 8 | G | G | G | Y | G | G | G | Y | G | G |
| 9 | R | R | R | G | R | Y | G | G | R | R |
| 10 | Y | R | R | G | R | R | G | G | R | R |
| 11 | Y | R | Y | G | Y | Y | G | G | Y | Y |
| 12 | R | R | R | G | Y | R | G | G | Y | Y |
| 13 | Y | Y | R | G | R | Y | G | G | R | R |
| 14 | Y | R | R | G | R | Y | G | G | R | R |
| 15 | Y | R | R | G | R | R | G | G | R | R |
| 16 | Y | R | Y | G | Y | G | G | G | Y | Y |
| 17 | Y | R | R | G | Y | R | G | G | Y | Y |
| 18 | Y | Y | Y | G | Y | Y | G | G | Y | Y |
| 19 | G | G | G | G | G | G | G | G | G | G |
| 20 | G | G | G | Y | G | G | G | G | G | G |
| 21 | G | G | G | G | G | G | G | G | G | G |
| 22 | R | R | R | G | R | R | G | G | R | R |
| 23 | G | G | G | G | G | G | G | G | G | G |
| 24 | G | G | G | G | N | N | G | G | N | N |
| 25 | G | N | N | G | N | N | G | G | N | N |

TABLE 1-continued

| S/N | L1 | L2 | L3 | L4 | L5 | L6 | L7 | L8 | L9 | L10 |
|---|---|---|---|---|---|---|---|---|---|---|
| 26 | G | G | G | G | G | N | G | G | G | G |
| 27 | G | G | G | G | G | G | G | G | G | G |
| 28 | G | G | G | G | N | N | G | G | N | N |
| 29 | G | N | N | G | N | N | G | G | N | N |

The historic data in Table 1 may be filtered or reduced according to the selected link. With the selected link of L6 and MB={L3, L5}, only the columns for L3, L5, and L6 are retained. The remained columns are filtered or removed. Table 2 illustrates the filtered data set.

TABLE 2

| L3 | L5 | L6 |
|---|---|---|
| G | N | N |
| G | G | G |
| Y | Y | Y |
| Y | Y | G |
| G | N | G |
| G | G | G |
| Y | G | Y |
| G | G | G |
| R | R | Y |
| R | R | R |
| Y | Y | Y |
| R | Y | R |
| R | R | Y |
| R | R | Y |
| R | R | R |
| Y | Y | G |
| R | Y | R |
| Y | Y | Y |
| G | G | G |
| G | G | G |
| G | G | G |
| R | R | R |
| G | G | G |
| G | N | N |
| N | N | N |
| G | G | N |
| G | G | G |
| G | N | N |
| N | N | N |

Using the filtered data of Table 2, the following marginal probabilities are calculated:

$$P(NCP_{L6}=RR \mid C_{L6}=R)=\frac{3}{5};$$

$$P(NCP_{L6}=RY \mid C_{L6}=R)=\frac{2}{5};$$

$$P(NCP_{L6}=RR \mid C_{L6}=Y)=\frac{3}{7};$$

$$P(NCP_{L6}=YY \mid C_{L6}=Y)=\frac{3}{7};$$

$$P(NCP_{L6}=YG \mid C_{L6}=Y)=\frac{1}{7};$$

$$P(NCP_{L6}=GG \mid C_{L6}=G)=\frac{8}{11};$$

$$P(NCP_{L6}=YY \mid C_{L6}=G)=\frac{2}{11};$$

$$P(NCP_{L6}=GN \mid C_{L6}=G)=\frac{1}{11};$$

and from the sample training data shown, all other $$P(NCP_{L6}=Y_j \mid C_{L6}=X)=0.$$

Also from Table 2, the absolute probabilities that link L6 experiences the three traffic ranges (R, G, Y) are provided by the number of rows for L6 in each classification divided by the total number of rows:

$$P(C_{L6}=R)=\frac{5}{29};$$

$$P(C_{L6}=G)=\frac{11}{29};\text{ and}$$

$$P(C_{L6}=Y)=\frac{7}{29}.$$

Consider a scenario where L6 has a missing data and the links in its Markov blanket are known such that: MB={L3=R, L5=Y}. The prediction of color L6 may be computed using the Bayesian traffic estimation model by finding the probability that L6 could be any of the traffic classifications (colors R, Y, G and B), as shown by equation 5 for Red:

$$P(C_{L6}=R \mid NCP_{L6}=RY)=$$

$$\frac{P(NCP_{L6}=RY \mid C_{L6}=R)\times P(C_{L6}=R)}{P(NCP_{L6}=RY \mid C_{L6}(t)=R)+P(NCP_{L6}=RR \mid C_{L6}(t)=R)+0}=\frac{\frac{2}{5}\times\frac{5}{29}}{\frac{2}{5}+\frac{3}{5}}=0.07$$

The prediction of color L6 is shown by equation 5 for Yellow:

$$P(C_{L6}=Y \mid NCP_{L6}=RY)=$$

$$\frac{P(NCP_{L6}=RY \mid C_{L6}=Y)\times P(C_{L6}=Y)}{\sum_j P(NCP_{L6}=Y_j \mid C_{L6}(t)=Y)}=\frac{0\times\frac{7}{29}}{0+\frac{3}{7}+\frac{3}{7}+\frac{1}{7}}=0$$

Therefore $P(C_{L6}=R|NCP_{L6}=RY)>P(C_{L6}=Y|NCP_{L6}=RY)$. While not shown, equation 5 also provides probabilities for L6 for Yellow and Green as 0. Because the probability for red is greater than the probability for yellow, the probability for green, and the probability for black, red is selected as the estimated traffic level for L6 when L3 is red and L5 is yellow.

Similar calculations may be performed for each link, and for each combination of causal links, and a table may be formed of the results. For example, for each road link in the road topology, the server 125 may define a lookup table. The lookup table has every combination of classifications for the causal links. For example, when there are two causal links and three classifications, there may be nine combinations. Some of the combinations may be removed when they are not present in the historical data.

Figure 8:
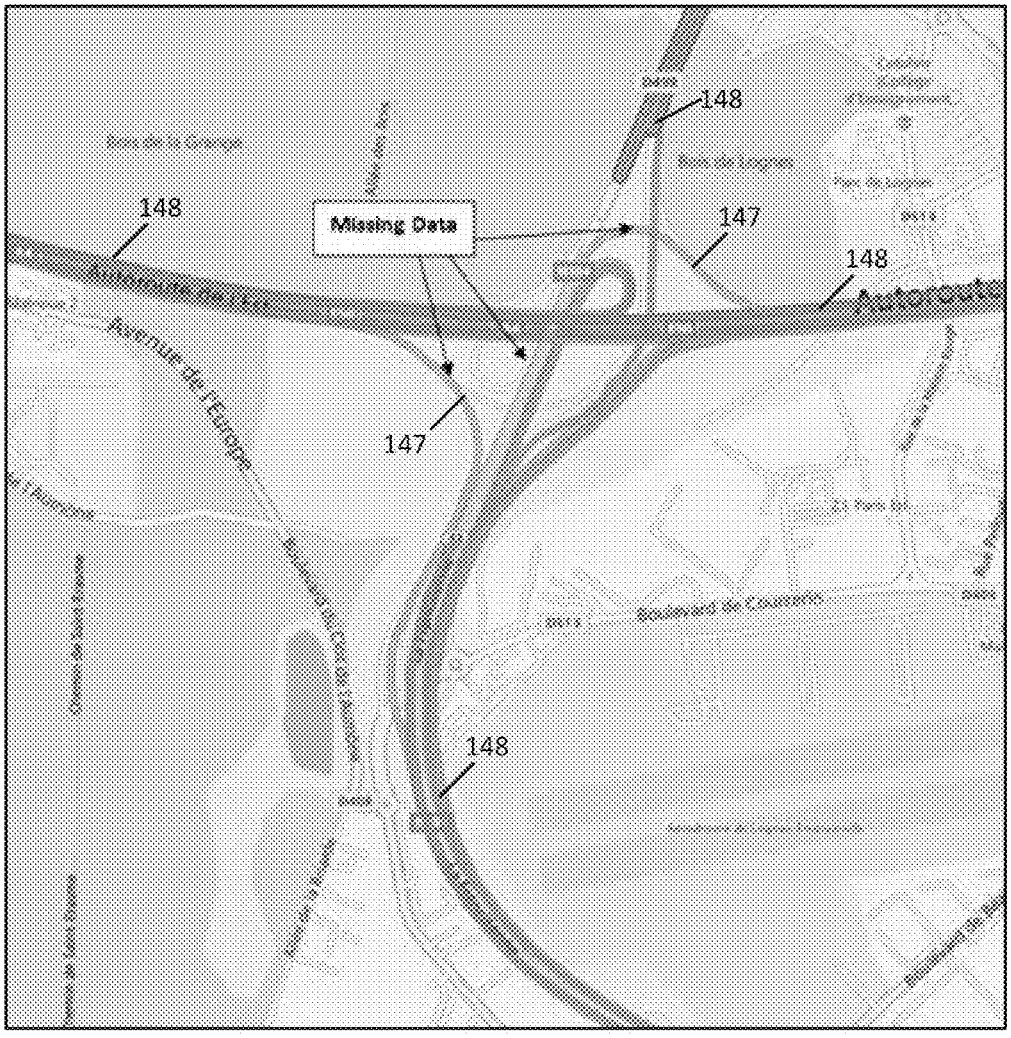
FIG. 8 illustrates locations of possible missing data from the example road topography of FIG. 6.

FIG. 8 illustrates locations of missing data from the example road topography of FIG. 6. The missing data are road links for which no real time or current traffic data is available. The server 125 may wait for a request for traffic data for the links with missing data. Alternatively, the server 125 may identify when data is missing independent of the requests.

The server 125 may identify that no real time traffic data is available by checking a database of real time probe data from all available sources. The database of real time probe data (e.g., database 123) may be a rolling database. That is, old data may be dropped and new data added over time. The expiration period for data in the real time database may be user configurable. Example expiration periods include 20 seconds, 1 minute, and 10 minutes. Other values may be used.

Based on the road link identifier of the missing data, the server 125 may select a lookup table. Each road link may have a separate table or an aggregate may be formed and segmented based on road link. The server 125 accesses real time data for the inputs to the lookup table that correspond to the related links (e.g., parent links, child links, parents of child links, or other supplemental links) to the selected link. The lookup table returns and estimated traffic level for the selected link. For example, using the table, the server 125 may provide inputs for the causal links or MB (e.g., L3=R, L5=Y) and receive an estimated output for the selected link (L6=R).

The server 125 may not always return the estimated traffic level from the table. In some examples, the server 126 may compare the conditional probability to a confidence threshold to determine whether the probability should be used to decide in real time if the prediction should be published or not. Estimated traffic values that are associated with conditional probabilities below the threshold may be dropped or dismissed. When the estimated traffic value is associated with a conditional probability above the threshold, the estimated traffic value is sent to the mobile device 122 or requesting device.

FIG. 7 illustrates an exemplary mobile device 122 of the system of FIG. 1. The mobile device 122 includes a processor 200, a memory 204, an input device 203, a communication interface 205, position circuitry 207, and a display 211. Additional, different, or fewer components are possible for the mobile device/personal computer 122. FIG. 8 illustrates an example flowchart for requesting or utilization the estimated traffic model. The acts of FIG. 8 may be performed by the mobile device 122, an advanced driving assistance system (ADAS), a HAD device or an autonomous vehicle, any of which may be referred to as a computing device. The acts may be applied in a different order. Acts may be omitted or repeated. Additional acts may be added.

Acts S101 and S103 may be alternatives. At act S101, the input device 203 receives a user input for a location. The input may be an origin or a destination in a request for routing. The input may be a location for which the user is requesting a traffic map. At act S103, the position circuitry 207 determines a geographic location for the mobile device 122. The geographic location may be used for a request for routing or for a traffic map.

In act S105, the processor 200 or the communication interface 205 sends the request for traffic information for a road topology. The road topology is the geographic area associated with the location from act S101 and/or act S103.

Acts S107 and S109 may be alternatives. In act S107, the communication interface 205 receives real time traffic information for at least one link in the road topology. The real time traffic information is based on probes that have collected data in a recent time period (e.g., 10 seconds, 1 minute, 10 minutes, or another value). In act S109, the communication interface 205 receives estimated traffic information for at least one link. This link has no associated real time traffic information. There may be no probes (data collecting mobile devices) traveling on this link during the recent time period. In addition, there may be no stationary probes assigned to the link.

The estimated traffic information is generated based on any of the embodiments described herein. The estimated traffic information may be based on a computer learned model or a marginal probability model. The estimated traffic information may be based on historical data for a narrow set of causal road links. The causal road links may include parent links, child links, and parents of the child links. The causal road link may be those links having a conditional probability with the road link that is greater than a threshold.

Figure 9:
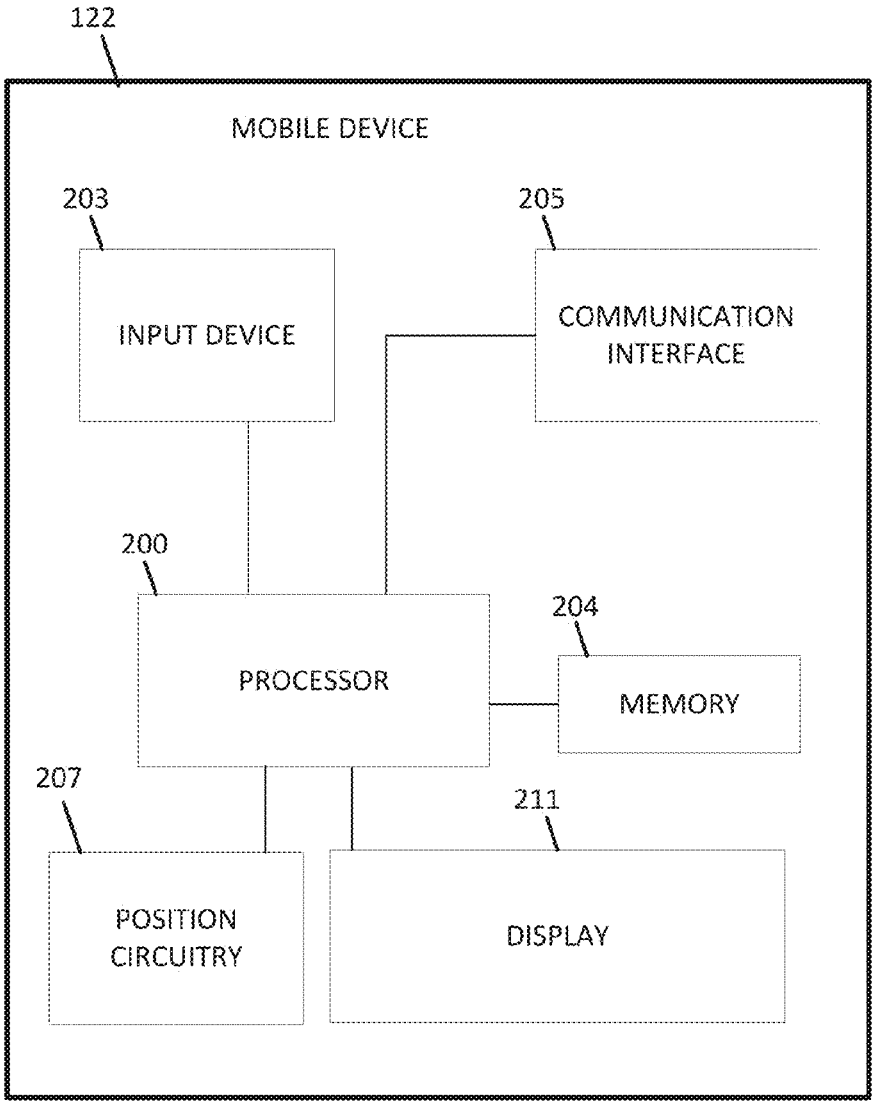
FIG. 9 illustrates an example mobile device for the system of FIG. 1.
Figure 10:
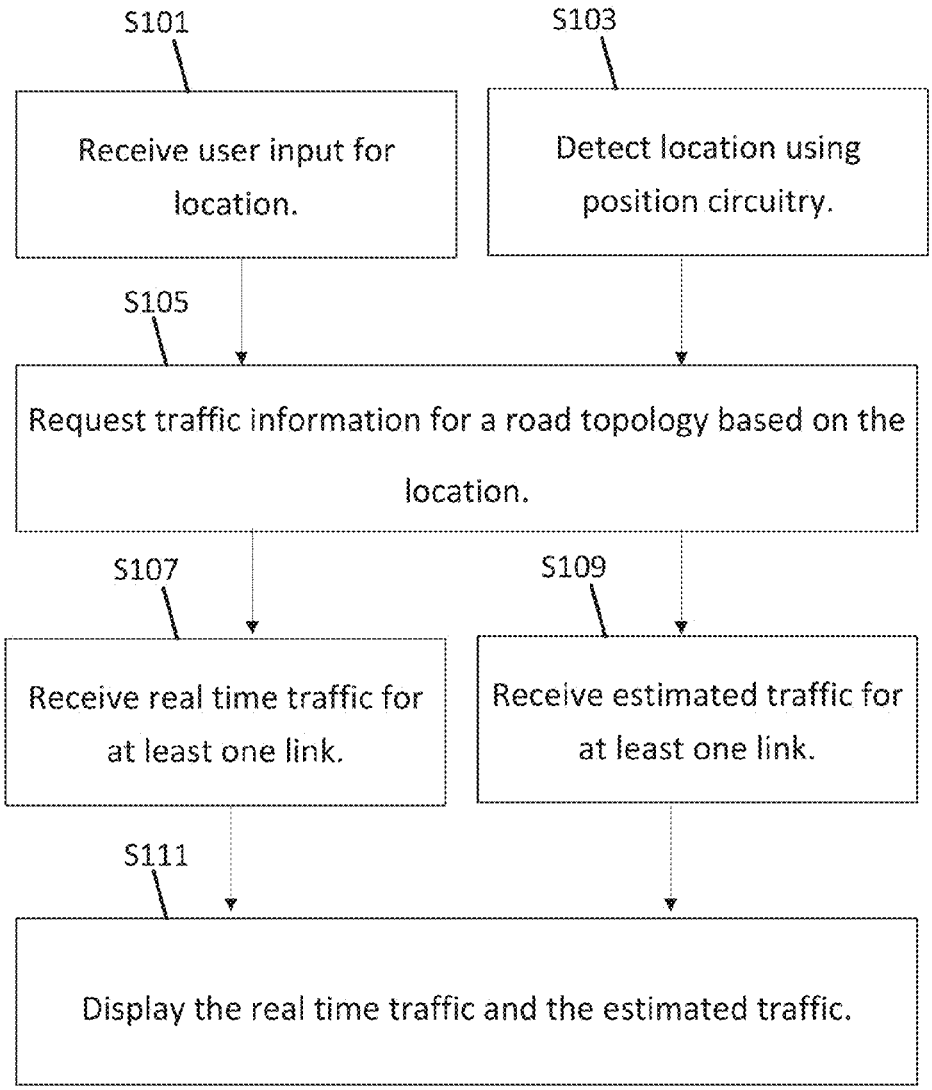
FIG. 10 illustrates an example flowchart for traffic classification based on a spatial neighbor model.
Figure 11:
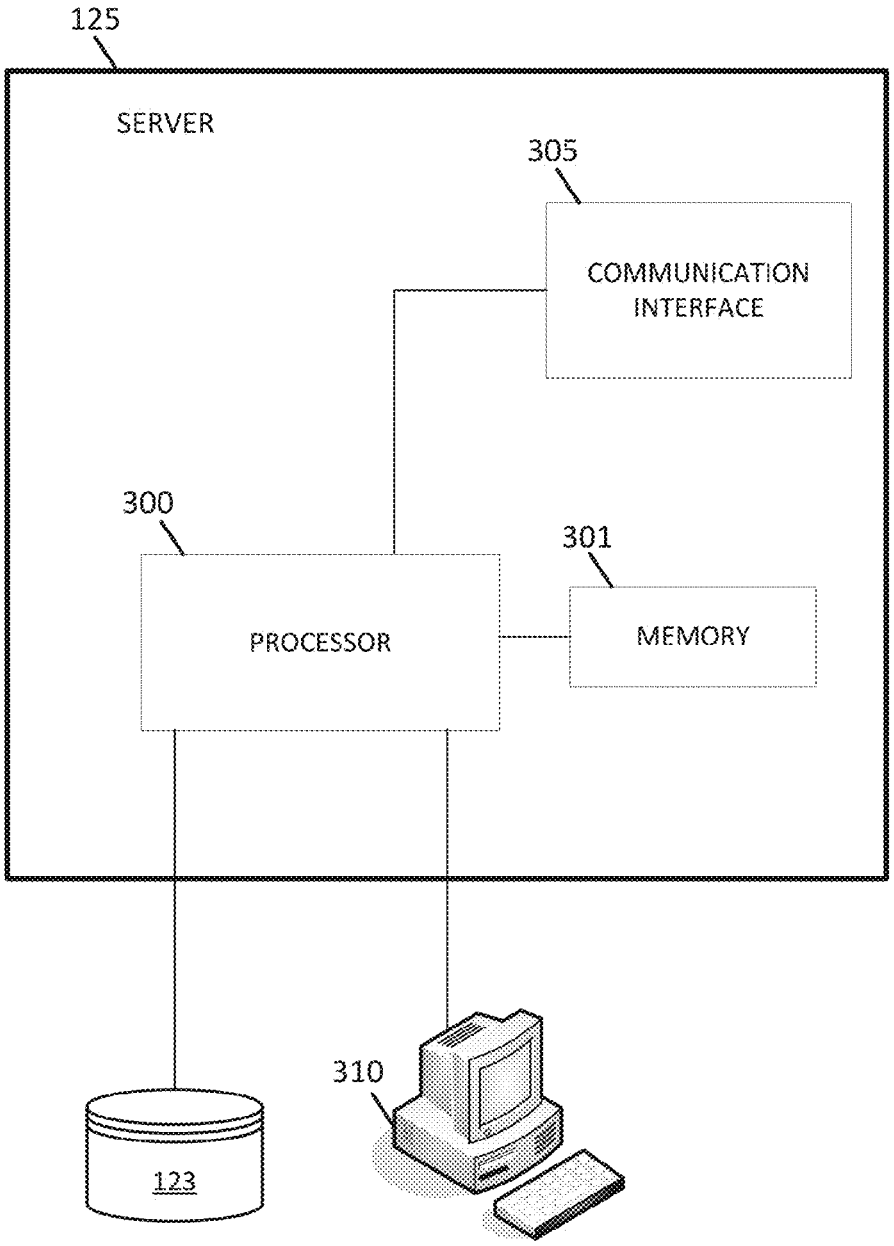
FIG. 11 illustrates an example network device of the system of FIG. 1.
Figure 12:
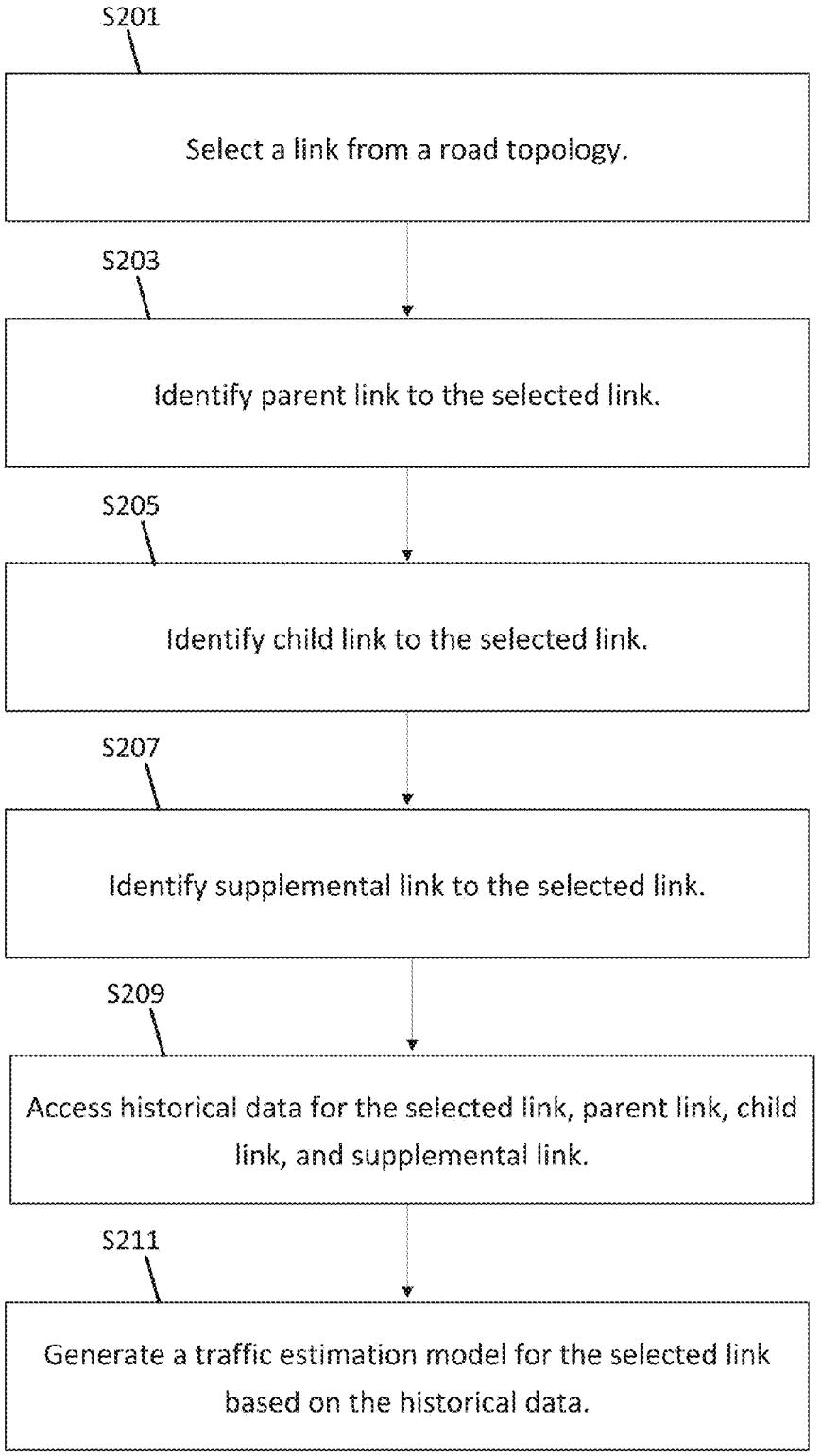
FIG. 12 illustrates an example flowchart for traffic classification based on a spatial neighbor model.

FIG. 9 illustrates an example network device (e.g., server 125) of the system of FIG. 1. The server 125 includes a processor 300, a communication interface 305, and a memory 301. The server 125 may be coupled to a database 123 and a workstation 128. The workstation 128 may be used as an input device for the server 125 for entering values for the thresholds, geographic regions, or other values. In addition, the communication interface 305 is an input device for the server 125. In certain embodiments, the communication interface 305 may receive data indicative of user inputs made via the workstation 128 or the mobile device 122. FIG. 10 illustrates an example flowchart for traffic classification based on a spatial neighbor model. The acts of the flowchart of FIG. 12 may alternatively be performed by the server 125 or another computing device. Different, fewer, or additional acts may be included.

At act S201, the processor 300 selects a link from a road topology. The road topology may be a neighborhood, town, city, or larger geographic area. For any given selected link in the road topology, more than one other link impacts the traffic levels on the selected link. For at least one given selected link (and also most of the links) in the road topology, at least one other link that is not directly adjacent to the selected link impacts the traffic level on the selected link.

At act S203, the processor 300 identifies a parent link for the selected link. The parent links include links for paths that can be taken directly to the selected link. In other words, a vehicle can be driven from a parent link directly into the selected link. At act S205, the processor 300 identifies a child link for the selected link. The child links include links for paths that can be taken directly from the selected link. In other words, a vehicle can be driven from the selected link directly onto a child link.

At act S207, the processor 300 identifies one or more supplemental links for the selected link. In one example, the supplemental links include sibling or cousin links. Sibling or cousin links are parent links of the child links of the selected links. In one example, the supplemental links are selected based on a relationship with the selected link. Historical data is analyzed to determine whether each of the other links in the road topology has a marginal probability with the selected links above a minimum threshold. Those links that exceed the threshold are designated as supplemental links. In a third example, links with a predetermined number of nodes away in the downstream direction (e.g., child links, grandchild links, great-grandchild links, and so on) or upstream direction (e.g., parent links, grandparent links, great-grandparent links, and so on) are designated as supplemental links.

At act S209, the processor 300 accesses historical data for the selected link, child link, parent link, and supplemental link. The historical data may be vectors of traffic levels recorded by probes. Each vector may correspond with a time slice. The data in the vectors may be absolute (55 miles per hour) or a classification rage (e.g., 1, 3 or 3; red, yellow, green).

At act S211, the processor 300 generates a traffic estimation model for the selected link based on the historical data. The traffic estimation model may be calculated using any of the techniques described herein. In some examples, the traffic estimation model is based on marginal probabilities calculated for each combination of each link and the corresponding child, parent, and supplemental links. In some examples, the traffic estimation model is based on a machine learned model. The traffic estimation model may be stored in memory 301.

The processor 300 may apply the traffic estimation model to real time traffic. For example, the processor 300 may periodically construct a traffic map for the road topology. The traffic map may be filled in with probe data for those links that real time data is available. For the one or more links with no probe data selected from the road topology, the processor 300 applies the traffic estimation model. In another example, a request for traffic data is received by the communication interface 305.

The link having no data is sent to the traffic estimation model. The processor 300 identifies a first subset of the road topology (e.g., the child, parent, and supplemental links) for the selected link. Real time data from these links are sent to the traffic estimation model, which returns an estimated traffic value, which may be represented by a level (e.g., high, medium, low, none), a color (e.g., black, red, yellow, green), or an absolute speed value (e.g., 20, 40, 60 miles per hour). The processor 300 may repeat this sequence for each of the links with no probe data. Thus, the processor 300 may select a second link from the road topology, identifying a second subset of the road topology (e.g., the child, parent, and supplemental links), and sends real time data from these links to the traffic estimation model, which returns an estimated traffic value for the second selected link. This may be repeated for any number of links or all links without real time data. This may be repeated periodically as real time data becomes available or unavailable.

The communication interface 305 may receive a routing request. The route from an origin to a destination may be calculated as a function of the estimated traffic value from the traffic estimation value. The route may also be calculated as a function of probe data for other links. The processor 300 may calculate the route to avoid road links that have certain traffic levels. In another example, the degree of traffic level impacts the time for traveling the road link and routes are compared based on traffic levels. Thus, one route may be selected over another route that has a link with no probe data but is associated with an estimated traffic level from the model.

The road link data records may be associated with attributes of or about the roads such as, for example, geographic coordinates, street names, address ranges, speed limits, turn restrictions at intersections, and/or other navigation related attributes (e.g., one or more of the road segments is part of a highway or tollway, the location of stop signs and/or stoplights along the road segments), as well as points of interest (POIs), such as gasoline stations, hotels, restaurants, museums, stadiums, offices, automobile dealerships, auto repair shops, buildings, stores, parks, etc. The node data records may be associated with attributes (e.g., about the intersections) such as, for example, geographic coordinates, street names, address ranges, speed limits, turn restrictions at intersections, and other navigation related attributes, as well as POIs such as, for example, gasoline stations, hotels, restaurants, museums, stadiums, offices, automobile dealerships, auto repair shops, buildings, stores, parks, etc. The geographic data may additionally or alternatively include other data records such as, for example, POI data records, topographical data records, cartographic data records, routing data, and maneuver data.

The databases 123 may be maintained by one or more map developers (e.g., the first company and/or the second company). A map developer collects geographic data to generate and enhance the database. There are different ways used by the map developer to collect data. These ways include obtaining data from other sources such as municipalities or respective geographic authorities. In addition, the map developer may employ field personnel (e.g., the employees at the first company and/or the second company) to travel by vehicle along roads throughout the geographic region to observe features and/or record information about the features. Also, remote sensing such as, for example, aerial or satellite photography may be used.

The database 123 may be master geographic databases stored in a format that facilitates updating, maintenance, and development. For example, a master geographic database or data in the master geographic database is in an Oracle spatial format or other spatial format, such as for development or production purposes. The Oracle spatial format or development/production database may be compiled into a delivery format such as a geographic data file (GDF) format. The data in the production and/or delivery formats may be compiled or further compiled to form geographic database products or databases that may be used in end user navigation devices or systems.

For example, geographic data is compiled (such as into a physical storage format (PSF) format) to organize and/or configure the data for performing navigation-related functions and/or services, such as route calculation, route guidance, map display, speed calculation, distance and travel time functions, and other functions, by a navigation device. The navigation-related functions may correspond to vehicle navigation, pedestrian navigation, or other types of navigation. The compilation to produce the end user databases may be performed by a party or entity separate from the map developer. For example, a customer of the map developer, such as a navigation device developer or other end user device developer, may perform compilation on a received geographic database in a delivery format to produce one or more compiled navigation databases.

The workstation 128 may be a general purpose computer including programming specialized for providing input to the server 125. For example, the workstation 128 may provide settings for the server 125. The settings may include the minimum probability threshold that defines whether a neighboring link is a supplemental link, the time periods that define time slice vectors, how the historical data is filtered (e.g., time period or functional classification), confidence thresholds for determining whether the estimated values are stored or dropped, or other settings. The workstation 128 may include at least a memory, a processor, and a communication interface.

The thresholds for traffic levels, conditional probabilities, and time periods for defining time slice vectors may be defined according to functional classifications for the road links stored as attributes in the database 123. Table 1 lists example classification systems that may be assigned numeric values for functional class. The functional class of the road segment may be described as a numerical value (e.g., 1, 2, 3, 4, and 5) represented in the feature vector. Functional class 1 may be highways while functional class 5 may be small streets. Table 1 further illustrates schemes having three to six functional classes.

TABLE 1

| Simple System | Complex System | U.S. Long Distance Roads | Highway Tags |
|---|---|---|---|
| Arterial Road | Interstates | Interstate Expressway | Motorway |
| Collector Road | Principal Arteries | Federal Highway | Trunk |
| Local Road | Minor Arteries | State Highway | Primary |
| | Major Collector | County Highway | Secondary |
| | Minor Collector | Local Road | Tertiary |
| | Local Road | | Residential |

One example of a simple system includes the functional classification maintained by the United States Federal Highway administration. The simple system includes arterial roads, collector roads, and local roads. The functional classifications of roads balance between accessibility and speed. An arterial road has low accessibility but is the fastest mode of travel between two points. Arterial roads are typically used for long distance travel. Collector roads connect arterial roads to local roads. Collector roads are more accessible and slower than arterial roads. Local roads are accessible to individual homes and business. Local roads are the most accessible and slowest type of road.

An example of a complex functional classification system is the urban classification system. Interstates include high speed and controlled access roads that span long distances. The arterial roads are divided into principle arteries and minor arteries according to size. The collector roads are divided into major collectors and minor collectors according to size. Another example functional classification system divides long distance roads by type of road or the entity in control of the highway. The functional classification system includes interstate expressways, federal highways, state highways, local highways, and local access roads. Another functional classification system uses the highway tag system in the Open Street Map (OSM) system. The functional classification includes motorways, trunk roads, primary roads, secondary roads, tertiary roads, and residential roads.

The vehicles 124 may be assisted driving vehicles. Assisted driving vehicles include autonomous vehicles, highly assisted driving (HAD), and advanced driving assistance systems (ADAS). Any of these assisted driving systems may be incorporated into mobile device 122. Alternatively, an assisted driving device may be included in the vehicle 124. The assisted driving device may include memory, a processor, and systems to communicate with the mobile device 122.

The term autonomous vehicle may refer to a self-driving or driverless mode in which no passengers are required to be on board to operate the vehicle. An autonomous vehicle may be referred to as a robot vehicle or an automated vehicle. The autonomous vehicle may include passengers, but no driver is necessary. These autonomous vehicles may park themselves or move cargo between locations without a human operator. Autonomous vehicles may include multiple modes and transition between the modes. The autonomous vehicle may steer, brake, or accelerate the vehicle based on the traffic estimation level of a current or upcoming road link.

A highly assisted driving (HAD) vehicle may refer to a vehicle that does not completely replace the human operator. Instead, in a highly assisted driving mode, the vehicle may perform some driving functions and the human operator may perform some driving functions. Vehicles may also be driven in a manual mode in which the human operator exercises a degree of control over the movement of the vehicle. The vehicles may also include a completely driverless mode. Other levels of automation are possible. The HAD vehicle may control the vehicle through steering or braking in response to the traffic estimation level of a current or upcoming road link.

Similarly, ADAS vehicles include one or more partially automated systems in which the vehicle alerts the driver. The features are designed to avoid collisions automatically. Features may include adaptive cruise control, automate braking, or steering adjustments to keep the driver in the correct lane. ADAS vehicles may issue warnings for the driver based on the traffic estimation level of a current or upcoming road link.

The computing device processor 200 and/or the server processor 300 may include a general processor, digital signal processor, an application specific integrated circuit (ASIC), field programmable gate array (FPGA), analog circuit, digital circuit, combinations thereof, or other now known or later developed processor. The mobile device processor 200 and/or the server processor 300 may be a single device or combinations of devices, such as associated with a network, distributed processing, or cloud computing. The computing device processor 200 and/or the server processor 300 may also be configured to cause an apparatus to at least perform at least one of methods described above.

The memory 204 and/or memory 301 may be a volatile memory or a non-volatile memory. The memory 204 and/or memory 301 may include one or more of a read only memory (ROM), random access memory (RAM), a flash memory, an electronic erasable program read only memory (EEPROM), or other type of memory. The memory 204 and/or memory 301 may be removable from the mobile device 122, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

The mobile device 122 may communicate with the network 127 and or the server 125 using wireless communication. The wireless communication may include the family of protocols known as WiFi or IEEE 802.11, the family of protocols known as Bluetooth, the family of protocols knows as near field communication (NFC), or cellular technologies (analog advanced mobile phone system (AMPS), the global system for mobile communication (GSM), third generation partnership project (3GPP), code division multiple access (CDMA), personal handy-phone system (PHS), and 4G or long term evolution (LTE) standards), or another protocol. Further, the network 127 may be a public network, such as the Internet, a private network, such as an intranet, or combinations thereof, and may utilize a variety of networking protocols now available or later developed including, but not limited to TCP/IP based networking protocols.

While the non-transitory computer-readable medium is described to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term "circuitry" or "circuit" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., E PROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

I claim:

1. A method comprising:

accessing a road topology comprising links from a geographic database;

selecting, using a processor, a link from the road topology;

identifying, using the processor, a subset of the road topology having neighboring links that have a significant conditional probability on the selected link; and generating, using the processor, a traffic estimation model for the selected link using the subset of road topology and historical traffic data for the neighboring links and historical traffic data for the selected link, wherein the subset of the road topology includes parent links of the selected link, child links of the selected link, and parent links of the child links of the selected link.

2. The method of claim 1, further comprising:

receiving current traffic data for the neighboring links;

applying the current traffic data for the neighboring links to the traffic estimation model for the selected link; and receiving a current traffic level for the selected link from the traffic estimation model for the selected link.

3. The method of claim 1, wherein the subset of the road topology includes a Markov blanket for the selected link in the road topology.

4. The method of claim 3, wherein the Markov blanket is defined according to road intersections.

5. The method of claim 3, wherein the Markov blanket is defined according to a functional classification of the selected link.

6. The method of claim 3, wherein the Markov blanket is defined according to time or a functional classification of the selected link.

7. An apparatus comprising:

at least one processor;

at least one display; and at least one memory including computer program code for one or more programs; the at least one memory and the computer program code configured to, with the at least one processor, cause the apparatus to:

request, using a processor, traffic information for a road topology including a first road link and a second road link;

receive real time traffic data for the first road link, wherein no real time traffic data is available for the second road link;

receive estimated traffic information for the second road link; and display, using the display, the traffic information, wherein the estimated traffic information is based a set of causal links that have a causal relationship with the second road link, and the causal links include at least one parent link that feeds traffic into the second road link, at least one child link that receives traffic from the second road link, and at least one supplemental link that feeds traffic into the at least one child link, wherein a conditional probability between each of the causal links and the second road link is greater than a probability threshold.

8. The method of claim 1, wherein the subset of the road topology shields the selected link from a remainder of the road topology such that a conditional probability between the selected link and any links in the remainder of the road topology is less than a minimum threshold probability.

9. The method of claim 1, wherein links of the road topology outside of the subset of the road topology have a conditional probability with the selected link that is less than a minimum threshold probability.

10. The method of claim 9, wherein the significant conditional probability is greater than the minimum threshold probability.

11. The method of claim 1, further comprising:

selecting a second link from the road topology;

identifying a second subset of the road topology having a second set of neighboring links that have the significant conditional probability on the second link; and generating a model for the second link using the second subset of road topology and historical traffic data for the second set of neighboring links.

12. The method of claim 1, wherein the model is generated from a conditional probability of each of the links in the subset of the road topology on the selected link.

13. The method of claim 1, wherein the model is generated based on training inputs and outputs on a machine learned model.

14. An apparatus comprising:

at least one processor; and at least one memory including computer program code for one or more programs; the at least one memory and the computer program code configured to, with the at least one processor, cause the apparatus to at least:

select a road link;

identify a set of causal links that have a causal relationship with the selected link, wherein a conditional probability between each of the causal links and the selected link is greater than a probability threshold, wherein the causal links include at least one parent link to the selected link, at least one child link to the selected link, and at least one supplemental link that is separated from the selected road link by the at least one child link or the at least one parent link; and generate a model for the selected link using historical data for the set of causal links and for the selected link, wherein the historical data is gathered by a traffic probe.

15. The apparatus of claim 14, wherein the at least one memory and the computer program code configured to, with the at least one processor, cause the apparatus to at least:

receive current traffic data for the set of causal links;

apply the current traffic data for the causal links to the model for the selected link; and receive a current traffic level for the selected link from the model for the selected link.

16. The apparatus of claim 14, wherein the causal links are a Markov blanket for the selected link based on intersections of a road network including the selected link and the causal links.

17. The apparatus of claim 16, wherein links of the road network outside of the causal links have a conditional probability with the selected link that is less than the probability threshold.

18. A method comprising:

requesting, using a processor, traffic information for a road topology including a first road link and a second road link;

receiving real time traffic data for the first road link, wherein no real time traffic data is available for the second road link;

receiving estimated traffic information for the second road link; and displaying the traffic information, wherein the estimated traffic information is based on a model generated from a set of causal links that have a causal relationship with the second road link, wherein a conditional probability between each of the causal links and the second road link is greater than a probability threshold, wherein the causal links include at least one parent link to the second road link, at least one child link to the second road link, and at least one supplemental link that is separated from the second road link by the at least one child link or the at least one parent link.

19. The method of claim 18, wherein links of a road network outside of the causal links have a conditional probability with the selected link that is less than the probability threshold.

* * * * *